US007051543B2

(12) United States Patent
Trujillo, Jr. et al.

(10) Patent No.: US 7,051,543 B2
(45) Date of Patent: May 30, 2006

(54) REFRIGERATION SYSTEM INCLUDING WATER CHILLING DEVICE

(76) Inventors: Salvador Trujillo, Jr., 2606 Bradbury Ct., Fort Collins, CO (US) 80521; Consuelo Trujillo, 2606 Bradbury Ct., Fort Collins, CO (US) 80521

( * ) Notice: Subject to any disclaimer, the term of this patent is extended or adjusted under 35 U.S.C. 154(b) by 268 days.

(21) Appl. No.: 10/767,098

(22) Filed: Jan. 30, 2004

(65) Prior Publication Data

US 2005/0166631 A1 Aug. 4, 2005

(51) Int. Cl.
*F25D 17/02* (2006.01)

(52) U.S. Cl. ..... 62/201; 62/434; 62/440; 62/441; 62/442; 62/435

(58) Field of Classification Search ..... 62/64, 62/201, 434, 435, 440, 441, 442
See application file for complete search history.

(56) References Cited

U.S. PATENT DOCUMENTS

| | | | | |
|---|---|---|---|---|
| 1,699,576 | A | 1/1929 | Wolverton | |
| 2,197,315 | A * | 4/1940 | Per | 62/129 |
| 2,258,906 | A | 10/1941 | Powers | |
| 2,436,426 | A | 2/1948 | Fish | |
| 2,744,391 | A | 5/1956 | Deane | |
| 3,635,040 | A | 1/1972 | Morris, Jr. | |
| 3,908,749 | A | 9/1975 | Williams | |
| 4,280,335 | A * | 7/1981 | Perez et al. | 62/332 |
| D327,966 | S | 7/1992 | Hikawa | |
| 5,191,773 | A | 3/1993 | Cassell | |
| D355,099 | S | 2/1995 | Dell | |
| 5,423,191 | A | 6/1995 | Bennett | |
| 5,613,423 | A | 3/1997 | Polster | |
| 5,797,270 | A | 8/1998 | Halterman et al. | |
| 6,121,583 | A | 9/2000 | Hansen | |
| 6,508,068 | B1 * | 1/2003 | Ohkawara | 62/185 |
| 2003/0182949 | A1 * | 10/2003 | Carr | 62/99 |

* cited by examiner

*Primary Examiner*—Cheryl Tyler
*Assistant Examiner*—B. Clayton McCraw

(57) ABSTRACT

A refrigeration system includes a housing and a plurality of pans removably positionable therein. A water chilling system is disposed within the housing and includes a compressor and a water reservoir housing a cooling coil disposed therein. A plurality of pipes are disposed inside and outside the water reservoir respectively for channeling chilled water out of the reservoir and warm water into the reservoir. A pump is disposed within the reservoir and connected to one of the plurality of pipes for pumping chilled water outwardly and away from the reservoir. A plurality of tubes are connected to the plurality of pipes for channeling water away from and towards the plurality of pipes, respectively. The water chilling system further includes a plurality of coils having substantially serpentine shapes selectively positionable within the pans for directing chilled water into the plurality of pans and for cooling the products disposed therein.

18 Claims, 5 Drawing Sheets

REFRIGERATION SYSTEM INCLUDING WATER CHILLING DEVICE

CROSS REFERENCE TO RELATED APPLICATIONS

Not Applicable.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND OF THE INVENTION

1. Technical Field

This invention relates to refrigeration devices and, more particularly, to a portable refrigeration system including a recirculating water chilling system. This system specifically addresses the need for an improved method of quickly cooling large volumes of hot foods such as sauces, stews, gravies, etc., in commercial kitchens and to the acceptable temperature for storage in a walk-in cooler or refrigerator.

2. Prior Art

In commercial establishments such as restaurants, bistros, hotels, bars, and the like, there is a need to store and chill large volumes of hot food until needed for reheating. One way of achieving this is to have large cool rooms or refrigeration cabinets where sufficient quantities of the product to be cooled can be stored so that the lowering of the temperature of the product can take place using standard refrigeration techniques. However, as most cool rooms are set to approximately +2 degrees Celsius, it can generally be expected to take some time for the food to be reduced to its desired temperature. Also, storing large quantities of hot food in walk-in coolers warms other food products locate therein. Such an effect is undesirable for obvious reasons. With restaurants and other similar establishments, this can give rise to significant problems.

Accordingly, in recent years, much emphasis has been placed on proper food storage temperatures in commercial kitchens. In fact, allowing food to linger in the so-called danger zone of 45 to 140 degrees Fahrenheit is one of the most common infractions cited by local health departments. Since many, if not most, restaurants generally prepare cooked foods ahead of time in comparatively large batches, this results in a need to quickly reduce them from comparatively high to comparatively low temperatures. Simply placing such items in a typical walk-in cooler is often inadvisable, as the compressor will encounter difficulty keeping up. This can result in such items taking longer than the mandated 6 hours to cool to 40 degrees, as well causing the temperature of any existing items in such a cooler to rise above a normally safe temperature.

Currently there are a variety of specialized quick chiller appliances on the market. Unfortunately, the oversized compressors employed in such appliances require 220-volt power, thereby requiring an establishment to install a dedicated power line. In addition, in order for them to achieve their high cooling rates, food must be placed in comparatively shallow, low volume, 2.5-inch deep pans.

Another typical approach for quickly chilling large quantities of food include the use of ice wands or bottles filled with frozen water. Their employment is fairly labor intensive, as they must be frequently used to stir the contents of the pans or vessels of foods in question to ensure a consistent reduction in temperature. They must also be frequently replaced with fresh units and must be refrozen in an establishment's generally crowded freezer. Also, the plastic wands or bottles are known to crack and break and thereby exposing the food to the bare ice.

This invention, therefore, seeks to overcome the problems and disadvantages observed in commercial kitchens by providing a portable, efficient system that lends itself to the relatively quick chilling of large quantities of hot foods such as sauces, gravies, stews and the like.

BRIEF SUMMARY OF THE INVENTION

In view of the foregoing background, this invention has been conceived and built as a portable, possible solution to the limitations of current methods of refrigerating large quantities of food in commercial kitchens. These and other objects, features and advantages of this invention are provided by a self-contained refrigeration system for cooling food such as sauces, gravies, and stews.

This appliance would, as with conventional quick chillers, feature a stainless steel cabinet. This cabinet is divided into two compartments: one to house the operating machinery, and the other compartment to house the set of rails used to position and support the steam-table sized pans that will be holding the hot food. Instead of a large compressor (200 volt) and cold air circulation system, this invention makes use of a comparatively small compressor (0.75 HP, 115 volt) and water, or direct contact based operating profile. The evaporator of this compressor would be immersed in a water reservoir where water will be chilled to almost freezing. This cold water would then be circulated via a small pump to a series of stainless steel heat exchangers that would be immersed in the pans of food loaded onto their rack positions.

The heat exchangers, or pan cooling coils, are bent into a serpentine fashion where one end of the coil acts as a cold-water receiving end while the other end of the coil allows the heated water to leave the cooling coil, be routed back to the water reservoir to be cooled and recirculated. The pump in the water reservoir is linked to the pan cooling coils via a stainless steel cold-water feeder pipe equipped with a series of intermediate ports having short runs of flexible tubing that will be attached to one end of the pan cooling coils.

The now-hot water is similarly routed to the stainless steel hot-water return pipe via the flexible tubing to its corresponding port and returned to the water reservoir. The clamps on each of the short runs of flexible tubing allow for the operation of one or more pans of food to be cooled without the involvement of unneeded ports. Food thermometers may be used in each pan of food being cooled for temperature monitoring.

The cabinet is mounted on industrial capacity casters allowing the refrigeration system to be easily transported and set in place.

This appliance uses a comparatively small compressor that eliminates the expense of installing a dedicated 220-volt line just for this chiller. The pump and the compressor could be wired to an electrical switch box on the cabinet to allow the pump and the compressor to be operated separately, if desired.

The design of the pan cooling coils permits the use of comparatively deep (6 inch deep) steam table compatible pans rather than the shallow (2.5 inch deep) pans used in currently available food chillers on the market. This invention would help increase the efficiency of a commercial kitchen. Although the stainless steel pan cooling coils would have to be cleaned after each use, they would not require periodic agitation while in the food being cooled.

This advantage would provide a greater level of efficiency and permit food to be cooled at a faster rate than would be otherwise possible. The protoype of this invention can cool about 20 gallons of sauce in about 3.5 hours using its six-pan capacity. The food cooled is already in steam-table pans at about 40 degrees Fahrenheit and can be stored in the walk-in cooler or refrigerator.

Consequently, this invention could offer lower operating costs and could enable food to cooled to a safe temperature at a rate faster than mandated time-frame required by health department regulations, thus, increasing the productivity of a commercial kitchen.

BRIEF DESCRIPTION OF THE SEVERAL VIEWS OF THE DRAWING

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

DETAILED DESCRIPTION OF THE INVENTION

Figure 1:
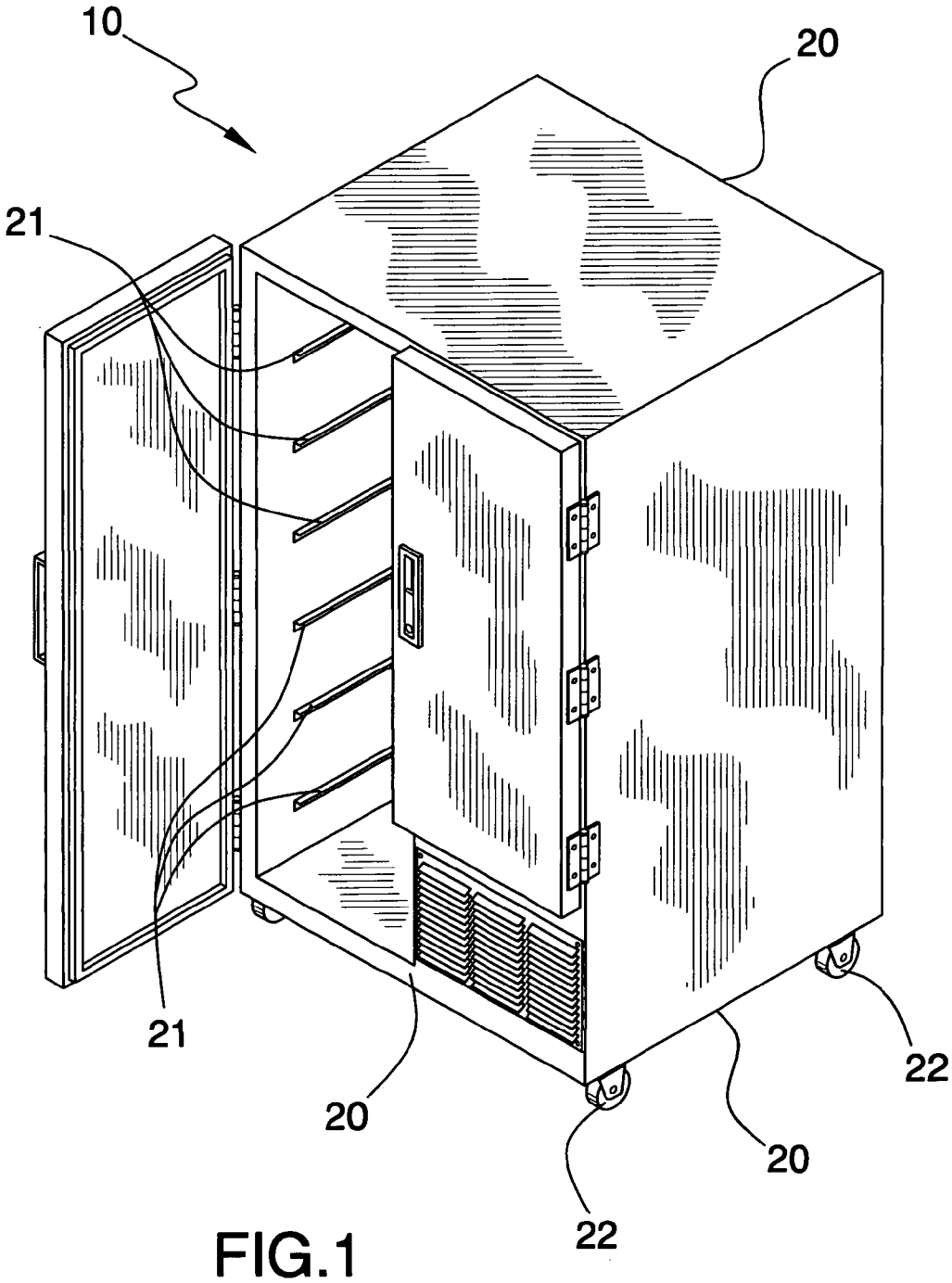
FIG. 1 is a perspective view showing the cabinet of this refrigeration system including a recirculating water chilling device, in accordance with the present invention.

The present invention will now be described more fully hereinafter with reference to the accompanying drawings, in which a preferred embodiment of the invention is shown. This invention may, however, be embodied in many different forms and should not be construed as limited to the embodiment set forth herein. Rather, this embodiment is provided so that this application will be thorough and complete, and will fully convey the true scope of the invention to those skilled in the art. Like numbers refer to like elements throughout the figures.

The cabinet of this invention is referred to generally in FIGS. 1–5 by the reference numeral 10 and is intended to provide a portable system for cooling food. It should be understood that the refrigeration system 10 may be used to cool many different types of items, including food, and fluids.

Initially referring to FIG. 1, the refrigeration system 10 includes a housing 20 including a plurality of rails 21 secured therein and spaced apart from each other. A plurality of pans 30 are removably positionable along the plurality of rails 21 for cooling food therein, as perhaps best shown in FIG. 4. The plurality of pans 30 are preferably formed from stainless steel to resist corrosion and to comply with health department regulations.

The housing 20 includes a plurality of casters 22 securable thereto and for allowing the refrigeration system 10 to be easily transported. The plurality of casters 22 are preferably industrial rated casters, as well known in the industry. Advantageously, the portability of the refrigeration system 10 enables a user to position it in a location most convenient for cooling food, such as in the kitchen.

Figure 2:
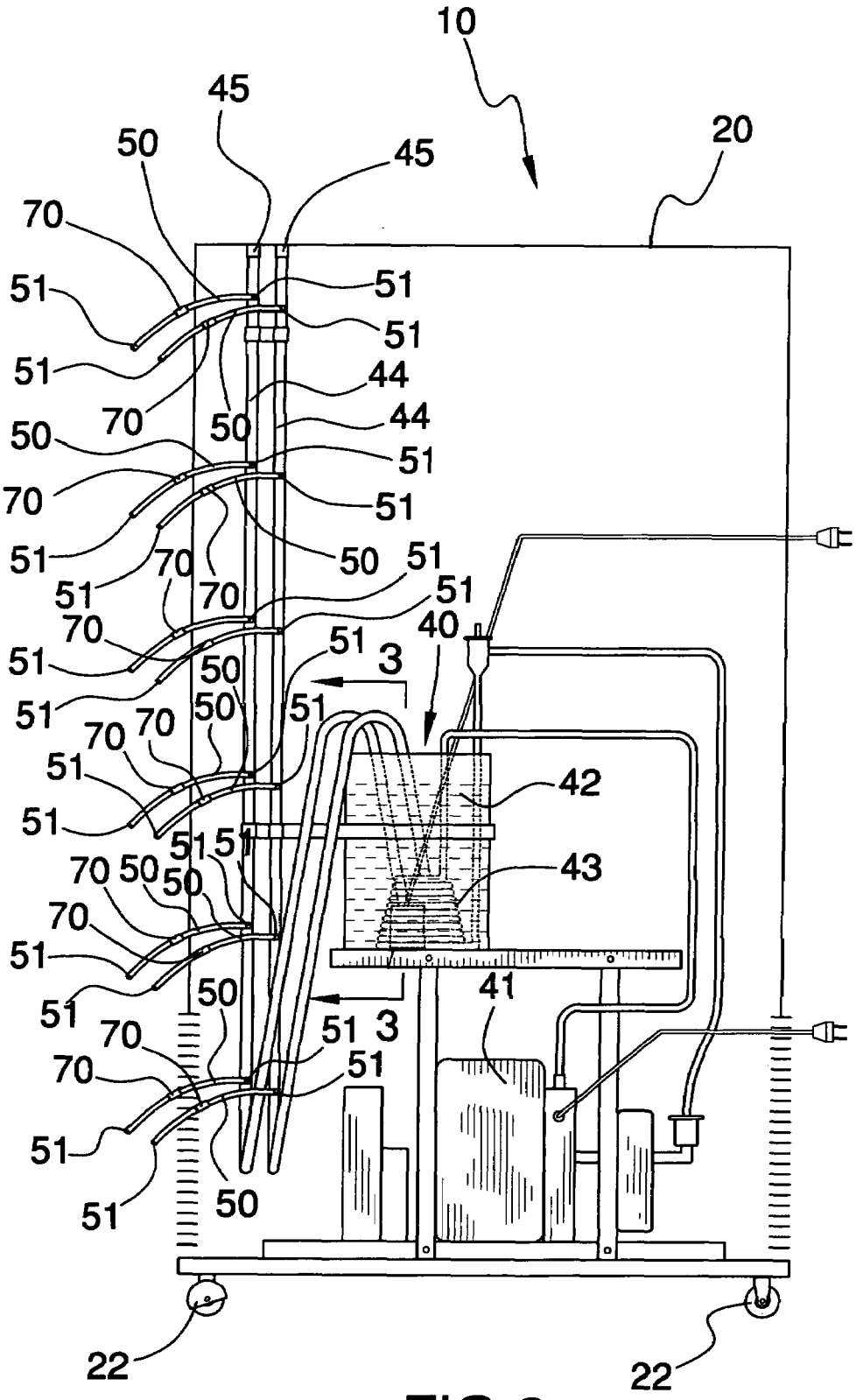
FIG. 2 is a cross-sectional view of the present invention shown in FIG. 1.
Figure 3:
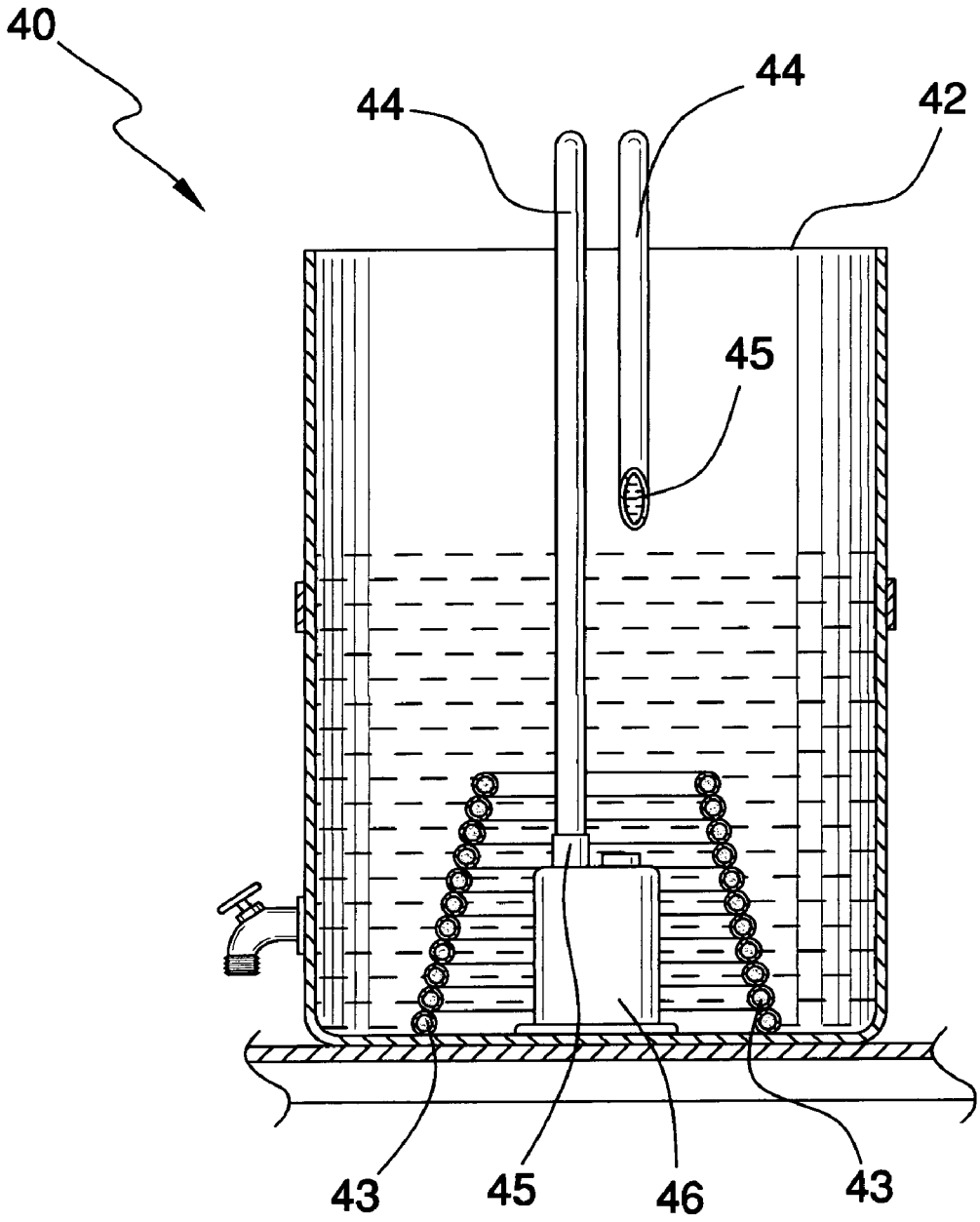
FIG. 3 is a cross-sectional view of the water chilling system shown in FIG. 2, taken along line 3—3.

Now referring to FIG. 2, the refrigeration system 10 further includes a water chilling system 40 disposed within the housing 20 and including a compressor 41 and a water reservoir 42 preferably formed from stainless steel to resist corrosion. The water reservoir 42 includes a cooling coil 43 disposed therein, as perhaps best shown in FIG. 3, and connected to the compressor 41 for chilling water disposed within the reservoir 42. The cooling coil 43 is also known as the evaporator in the HVAC industry.

Still referring to FIG. 2, the water chilling system 40 further includes a plurality of pipes 44 preferably formed from stainless steal to resist corrosion and having opposed end portions 45 disposed inside and outside the water reservoir 42 respectively. The plurality of pipes 44 cooperate with each other for channeling chilled water out of the reservoir 42 and warm water into the reservoir 42. The water chilling system 40 further includes a pump 46 disposed within the reservoir and connected to one of the plurality of pipes 44 for pumping chilled water outwardly and away from the reservoir 42, as perhaps best shown in FIG. 3.

A plurality of tubes 50 having opposed end portions 51 are connected to the plurality of pipes 44 for channeling water away from and towards the plurality of pipes 44. One of the plurality of pipes 44 is disposed adjacent the cooling coil 43 for pumping chilled water out of the reservoir 42 and another of the plurality of pipes 44 is disposed above the cooling coil 43 for dispensing warm return water into the reservoir 42.

Figure 4:
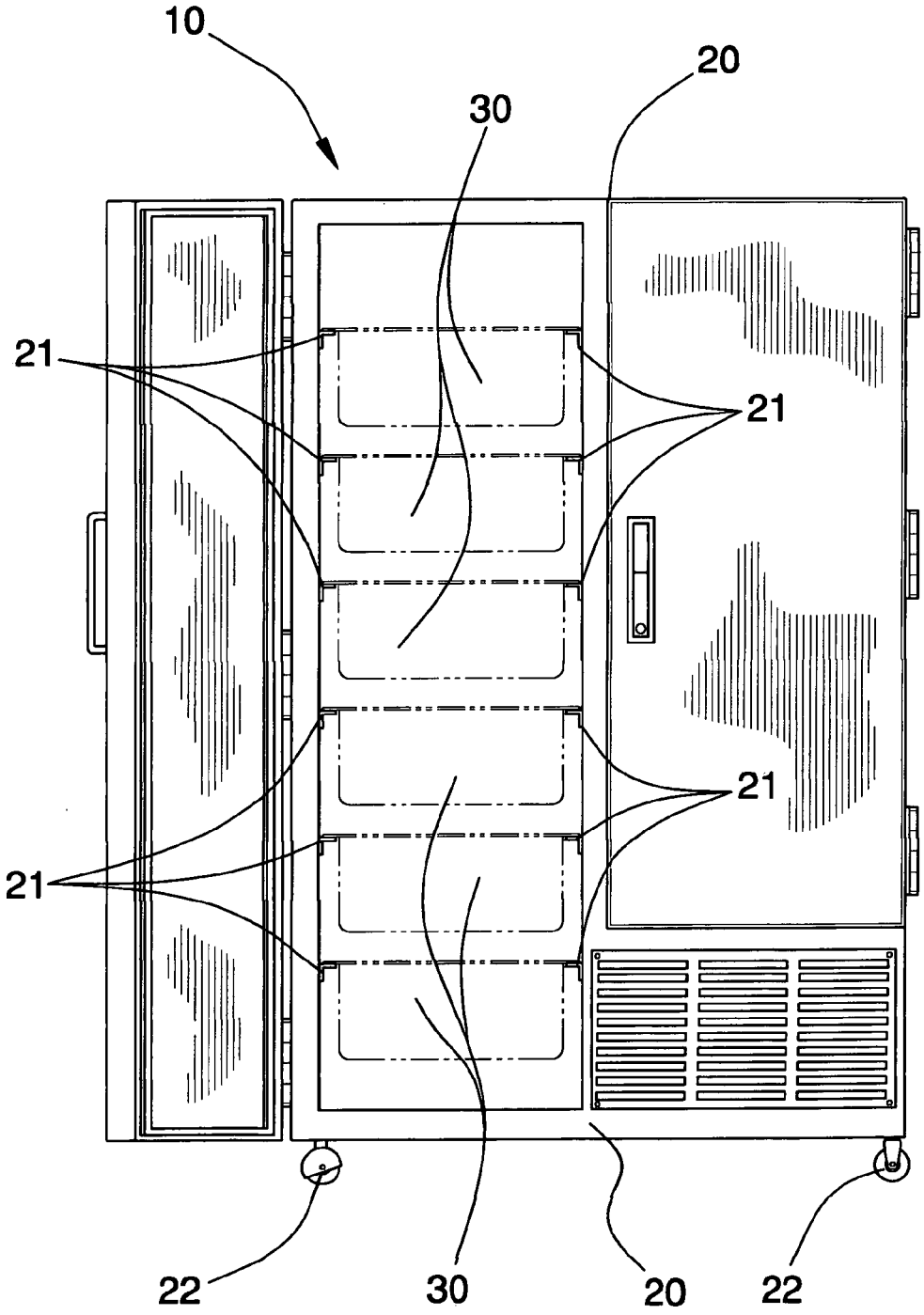
FIG. 4 is a front elevational view of the present invention shown in FIG. 1.
Figure 5:
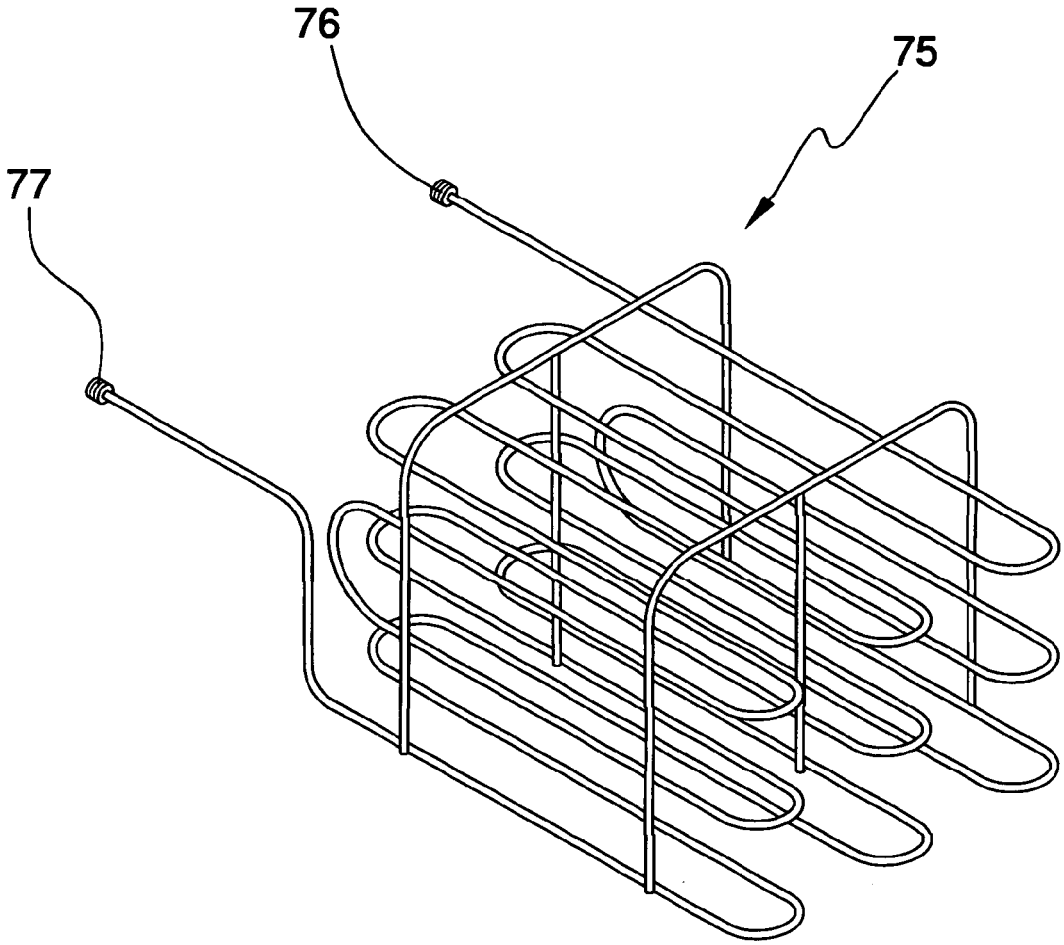
FIG. 5 is a perspective view showing a serpentine shaped coil employable by the present invention.

Now referring to FIGS. 4 and 5, the water chilling system 40 further includes a plurality of coils 75 having substantially serpentine shapes, selectively positionable within the plurality of pans 30 and having opposed end portions 76, 77 connected to the plurality of tubes 50, respectively. The plurality of coils 75 direct chilled water into the plurality of pans 30 for cooling the food products disposed therein. Advantageously, the plurality of coils 75 provide direct cooling to the pans 30 instead of relying primarily upon the cooling of the air temperature inside the system as conventional refrigeration devices do. The result is quicker and more efficient refrigeration. A plurality of conventional thermometers may also be connected to the plurality of pans 30 for displaying a temperature thereof respectively. This enables an operator to quickly check the temperature of individual pans 30 to ensure that proper cooling levels are maintained to prevent the growth of bacteria.

Referring back to FIG. 2, the refrigeration system 10 further includes a plurality of clamps 70 attachable to the plurality of tubes 50 and for selectively controlling water flow therethrough respectively. The plurality of clamps 70 are preferably formed from plastic to reduce weight and resist corrosion, but may be formed from metal. The plurality of clamps 70 enable an operator to selectively direct chilled water to the pans 30 containing food, thereby increasing the cooling efficiency of the refrigeration system 10 by eliminating the cooling of unused pans 30.

Thus, the refrigeration system 10 offers an improved method of refrigerating and quickly chilling large volumes of food. Restaurants and other related establishments will appreciate its compact, portable design and its ability to reduce food temperatures at a faster rate than conventional refrigeration systems. In particular, because of its unique structural design, this invention has a distinct functional purpose desirable for any commercial kitchen that prepares certain foods in large volumes, such as 10 or more gallons at a time. If these foods are to be cooled and stored for use at a later time, the hot food can be cooled to 41 degrees Fahrenheit in about half the mandated time required by health department regulations to prevent conditions conducive to bacterial growth.

While the invention has been described with respect to a certain specific embodiment, it will be appreciated that many modifications and changes may be made by those skilled in the art without departing from the spirit of the invention. It is intended, therefore, by the appended claims to cover all such modifications and changes as fall within the true spirit and scope of the invention.

In particular, with respect to the above description, it is to be realized that the optimum dimensional relationships for the parts of the present invention may include variations in size, materials, shape, form, function and manner of operation. The assembly and use of the present invention are deemed readily apparent and obvious to one skilled in the art.

The invention claimed is:

1. A refrigeration system for cooling food and comprising:
- a housing including a plurality of rails secured therein and spaced apart from each other;
- a plurality of pans removably positionable along said plurality of rails respectively and for storing water and food therein; and
- a water chilling system disposed within said housing and including
  - a compressor,
  - a water reservoir including a cooling coil disposed therein and connected to said compressor for chilling water disposed within said reservoir,
  - a plurality of pipes having opposed end portions disposed inside and outside said water reservoir respectively, said plurality of pipes cooperating with each other for channeling chilled water out of said reservoir and warm water into said reservoir,
  - a pump disposed within said reservoir and connected to one said plurality of pipes for pumping chilled water outwardly and away from said reservoir,
  - a plurality of tubes having opposed end portions connected to said plurality of pipes and for channeling water away from and towards said plurality of pipes, and
  - a plurality of coils selectively positionable within said pans and having opposed end portions connected to said plurality of tubes and for directing chilled water into said plurality of pans for cooling the water and food products disposed therein.

2. The refrigeration system of claim 1, further comprising a plurality of clamps attachable to said plurality of tubes and for selectively controlling water flow therethrough respectively.

3. The refrigeration system of claim 1, further comprising a plurality of thermometers connectable to said plurality of pans and for displaying a temperature thereof respectively.

4. The refrigeration system of claim 1, further comprising a plurality of casters securable to said housing and for allowing same to be easily transported.

5. The refrigeration system of claim 1, wherein said one pipe is disposed adjacent said cooling coil for pumping chilled water out of said reservoir and another said plurality of pipes is disposed above said cooling coil for dispensing warm return water into said reservoir.

6. The refrigeration system of claim 1, wherein said plurality of coils have substantially serpentine shapes.

7. The refrigeration system of claim 1, wherein said plurality of pipes are formed from stainless steel.

8. A refrigeration system for cooling food and comprising:
- a housing including a plurality of rails secured therein and spaced apart from each other;
- a plurality of pans removably positionable along said plurality of rails respectively and for cooling food therein;
- a water chilling system disposed within said housing and including
  - a compressor,
  - a water reservoir including a cooling coil disposed therein and connected to said compressor for chilling water disposed within said reservoir,
  - a plurality of pipes having opposed end portions disposed inside and outside said water reservoir respectively, said plurality of pipes cooperating with each other for channeling chilled water out of said reservoir and warm water into said reservoir,
  - a pump disposed within said reservoir and connected to one said plurality of pipes for pumping chilled water outwardly and away from said reservoir,
  - a plurality of tubes having opposed end portions connected to said plurality of pipes and for channeling water away from and towards said plurality of pipes, and
  - a plurality of coils selectively positionable within said pans and having opposed end portions connected to said plurality of tubes and for directing chilled water into said plurality of pans for cooling the water and food products disposed therein; and
- a plurality of clamps attachable to said plurality of tubes and for selectively controlling water flow therethrough respectively.

9. The refrigeration system of claim 8, further comprising a plurality of thermometers connectable to said plurality of pans and for displaying a temperature thereof respectively.

10. The refrigeration system of claim 8, further comprising a plurality of casters securable to said housing and for allowing same to be easily transported.

11. The refrigeration system of claim 8, wherein said one pipe is disposed adjacent said cooling coil for pumping chilled water out of said reservoir and another said plurality of pipes is disposed above said cooling coil for dispensing warm return water into said reservoir.

12. The refrigeration system of claim 8, wherein said plurality of coils have substantially serpentine shapes.

13. The refrigeration system of claim 8, wherein said plurality of pipes are formed from stainless steel.

14. A refrigeration system for cooling food and comprising:
- a housing including a plurality of rails secured therein and spaced apart from each other;
- a plurality of pans removably positionable along said plurality of rails respectively and for cooling food therein;
- a water chilling system disposed within said housing and including
  - a compressor,
  - a water reservoir including a cooling coil disposed therein and connected to said compressor for chilling water disposed within said reservoir,
  - a plurality of pipes having opposed end portions disposed inside and outside said water reservoir respectively, said plurality of pipes cooperating with each other for channeling chilled water out of said reservoir and warm water into said reservoir, a pump disposed within said reservoir and connected to one said plurality of pipes for pumping chilled water outwardly and away from said reservoir, a plurality of tubes having opposed end portions connected to said plurality of pipes and for channeling water away from and towards said plurality of pipes, and a plurality of coils selectively positionable within said pans and having opposed end portions connected to said plurality of tubes and for directing chilled water into said plurality of pans for cooling the water and food products disposed therein;

a plurality of clamps attachable to said plurality of tubes and for selectively controlling water flow therethrough respectively; and a plurality of thermometers connectable to said plurality of pans and for displaying a temperature thereof respectively.

15. The refrigeration system of claim 14, further comprising a plurality of casters securable to said housing and for allowing same to be easily transported.

16. The refrigeration system of claim 14, wherein said one pipe is disposed adjacent said cooling coil for pumping chilled water out of said reservoir and another said plurality of pipes is disposed above said cooling coil for dispensing warm return water into said reservoir.

17. The refrigeration system of claim 14, wherein said plurality of coils have substantially serpentine shapes.

18. The refrigeration system of claim 14, wherein said plurality of pipes are formed from stainless steel.

* * * * *